US005359982A

United States Patent [19]

Taruya

[11] Patent Number: 5,359,982

[45] Date of Patent: Nov. 1, 1994

[54] IGNITOR FOR AN INTERNAL COMBUSTION ENGINE

[75] Inventor: Masaaki Taruya, Himeji, Japan

[73] Assignee: Mitsubishi Denki Kabushiki Kaisha, Tokyo, Japan

[21] Appl. No.: 104,585

[22] Filed: Aug. 11, 1993

[30] Foreign Application Priority Data

Aug. 13, 1992 [JP] Japan ..... 4-216180

[51] Int. Cl.[5] ..... F02P 11/00

[52] U.S. Cl. ..... 123/634; 123/643; 336/96

[58] Field of Search ..... 123/634, 635, 647, 644, 123/633; 336/96, 192; 29/602.1; 361/253, 278, 247, 386

[56] References Cited

U.S. PATENT DOCUMENTS

| | | | |
|---|---|---|---|
| 5,003,959 | 4/1991 | Umezaki et al. | 123/647 |
| 5,170,767 | 12/1992 | Wada et al. | 123/633 |
| 5,170,768 | 12/1992 | Eileraas | 123/634 |
| 5,172,302 | 12/1992 | Taruya et al. | 361/386 |
| 5,186,154 | 2/1993 | Takaishi et al. | 123/634 |
| 5,191,872 | 3/1993 | Takaishi et al. | 123/647 |
| 5,241,941 | 9/1993 | Hancock et al. | 123/634 |
| 5,257,611 | 11/1993 | Chapekis et al. | 123/634 |
| 5,271,373 | 12/1993 | Takaishi et al. | 123/634 |
| 5,285,760 | 2/1994 | Takaishi et al. | 123/634 |
| 5,296,999 | 3/1994 | Taruya | 361/247 |
| 5,313,927 | 5/1994 | Takaishi et al. | 123/634 |
| 5,315,982 | 5/1994 | Ward et al. | 123/634 |

FOREIGN PATENT DOCUMENTS

| | | | |
|---|---|---|---|
| 4441 | 1/1993 | Japan | 123/634 |

*Primary Examiner*—Raymond A. Nelli
*Attorney, Agent, or Firm*—Sughrue, Mion, Zinn, Macpeak and Seas

[57] ABSTRACT

An ignitor comprising a casing, an ignition coil (1) disposed within the casing (20), a power-transistor package (26) disposed within the casing (20) and electrically connected to the ignition coil (1) for interrupting an electric current flowing through the ignition coil (1), an electrical connector (21) mechanically attached to the power-transistor package (26) and for electrically connecting the ignition coil (1) and the power transistor package (26) to an external circuit and an electrically insulating resin (28) filled within the casing for hermetically sealing and supporting therein the ignition coil (1) and the power-transistor package (26). The power transistor package (26) may comprises a holder (23) mounting the mold resin package and electrically connecting the electrical connector (21) to the power-transistor package (26) and the electrical connector (21) may be fixed to the holder (23) by fastening means (22, 24).

7 Claims, 3 Drawing Sheets

IGNITOR FOR AN INTERNAL COMBUSTION ENGINE

BACKGROUND OF THE INVENTION

This invention relates to an ignitor for an internal combustion engine.

FIG. 3 is an exploded perspective view of a known ignitor for an internal combustion engine. The ignitor comprises an ignition coil 1 disposed within an interior space or a coil mounting portion 11 of a casing 10. The ignition coil 1 comprises an iron core 2 disposed partially in the mounting portion 11 of the casing 10, a primary winding 4 wound around the iron core 2 within the casing 10 and a secondary winding 5 wound on the outer circumference of the primary winding 4.

A resin-molded power-transistor package 6 is disposed within the casing 10. The power-transistor package 6 is supported by means of a holder 8 which is inserted into the casing 10 along a pair of guides 13 disposed to two of internal surfaces of the side walls of the casing 10. The power-transistor package 6 is composed of a power transistor (not shown), the current limiting circuit (not shown), etc. which are mounted on a lead frame (not shown) having a plurality of leads 15 and are hermetically sealed with a suitable resin. The power-transistor package 6 is covered with cover means such as a silicone sheet 7.

The casing 10 also integrally comprises an electrical connector 12 which has integrally formed therein a plurality of connector terminals 12*a* electrically connected to the ignition coil 1 and terminals 6*a* of the power-transistor package 6 through holder terminals 8*a* of the holder 8 and a separate conductor (not shown). One of the terminal 6*a* of the power-transistor package 6 is also electrically connected to the ignition coil 1 through the holder terminal 8*a* of the holder 8. Disposed to the bottom of the casing 10 is a secondary terminal 14 for supplying a high voltage generated in the secondary winding 5 of the ignition coil 1 to the ignition plug (not shown) through the distributor (not shown) to ignite the internal combustion engine (not shown).

An insulating resinous filler material (not shown) is filled within the interior space of the casing 10 for unifying and protecting the ignition coil 1 and the power-transistor package 6. The insulating resinous filler material and the power-transistor package 6 have different coefficients of thermal expansion each other, however, the silicone sheet 7 which covers the power-transistor package 6 absorbs a stress caused by the difference between these coefficients of thermal expansion thereof resulting from repeated violent changes of temperature of the surroundings thereof.

In the known ignitor as above described, when the power transistor of the power-transistor package 6 turns off to interrupt a primary current flowing through the primary winding 4 of the ignition coil 1 in accordance with an ignition timing of the internal combustion engine (not shown), a high voltage generates on the secondary winding 5 of the ignition coil 1 and is supplied to the distributor (not shown) through the secondary terminal 14 to ignite the internal combustion engine (not shown).

In the manufacture of the known ignitor as described above, firstly, the primary winding 4 is disposed within the mounting portion 11 of the casing 10 and the secondary winding 5 is disposed around the primary winding 4. Next, the power-transistor package 6 is covered with the silicone sheet 7 and mounted on the holder 8 so that the terminals 6*a* of the power-transistor package 6 is electrically connected to the holder terminals 8*a* of the holder 8. Thus, the power-transistor package 6 with the silicone sheet 7 thereon and the holder 8 constitute a power-transistor package assembly. The power-transistor package 6 is mounted to the mounting portion 11 of the casing 10 together with the silicone sheet 7 and the holder 8 along the pair of guides 13 disposed to the internal surfaces of the casing 10 opposite to each other. Then, the primary and secondary windings 4 and 5 of the ignition coil 1, the holder terminals 8*a* of the holder 8, the terminals 12*a* of the connector 12 and the secondary terminal 14 are electrically connected to the respective components. Further, the iron core 2 is inserted into the primary coil 4 and the insulating resinous filler material (not shown) is poured into the interior space of the casing 10 and cured to unify and seal the ignition coil 1 and the power-transistor package 6 within the casing 10.

In the known ignitor, as described above, after the primary and secondary windings 4 and 5 of the ignition coil 1 and the power-transistor package 6 with the holder 8 (power transistor package assembly) is mounted within the mounting portion 11 of the casing 10, electrical connections must be provided between the terminals 12*a* of the connector 12 and the ignition coil 1 within the limited space in the casing 10. Some of the electrical connections may be provided through direct connections between terminals but some other electrical connections such as the connections between the connector terminal 12*a* and the ignition coil 1 must be provided through separate electrical conductors. These connecting portions sometimes fail to be tightly and correctly connected and it may be easily damaged.

Further, since the connector 12 is integrally formed in the casing 10, the shape and the mounting direction of the connector 12 are difficult to change and, therefore, the known ignitor has a poor versatility in the industry.

SUMMARY OF THE INVENTION

Accordingly, one object of the present invention is to provide an ignitor for an internal combustion engine free from the above-discussed disadvantages of the known design of the ignitor.

Another object of the present invention is to provide an ignitor which can be easily assembled and reliable.

A further object of the present invention is to provide an ignitor which is versatile for use in various internal combustion engines.

With the above objects in view, the ignitor of the present invention comprises a casing, an ignition coil disposed within the casing, a power-transistor package disposed within the casing and electrically connected to the ignition coil for interrupting an electric current flowing through the ignition coil, an electrical connector mechanically attached to the power-transistor package and for electrically connecting the coil and the power transistor package to an external circuit, an electrically insulating resin filled within the casing hermetically sealing and supporting the ignition coil and the power-transistor package.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
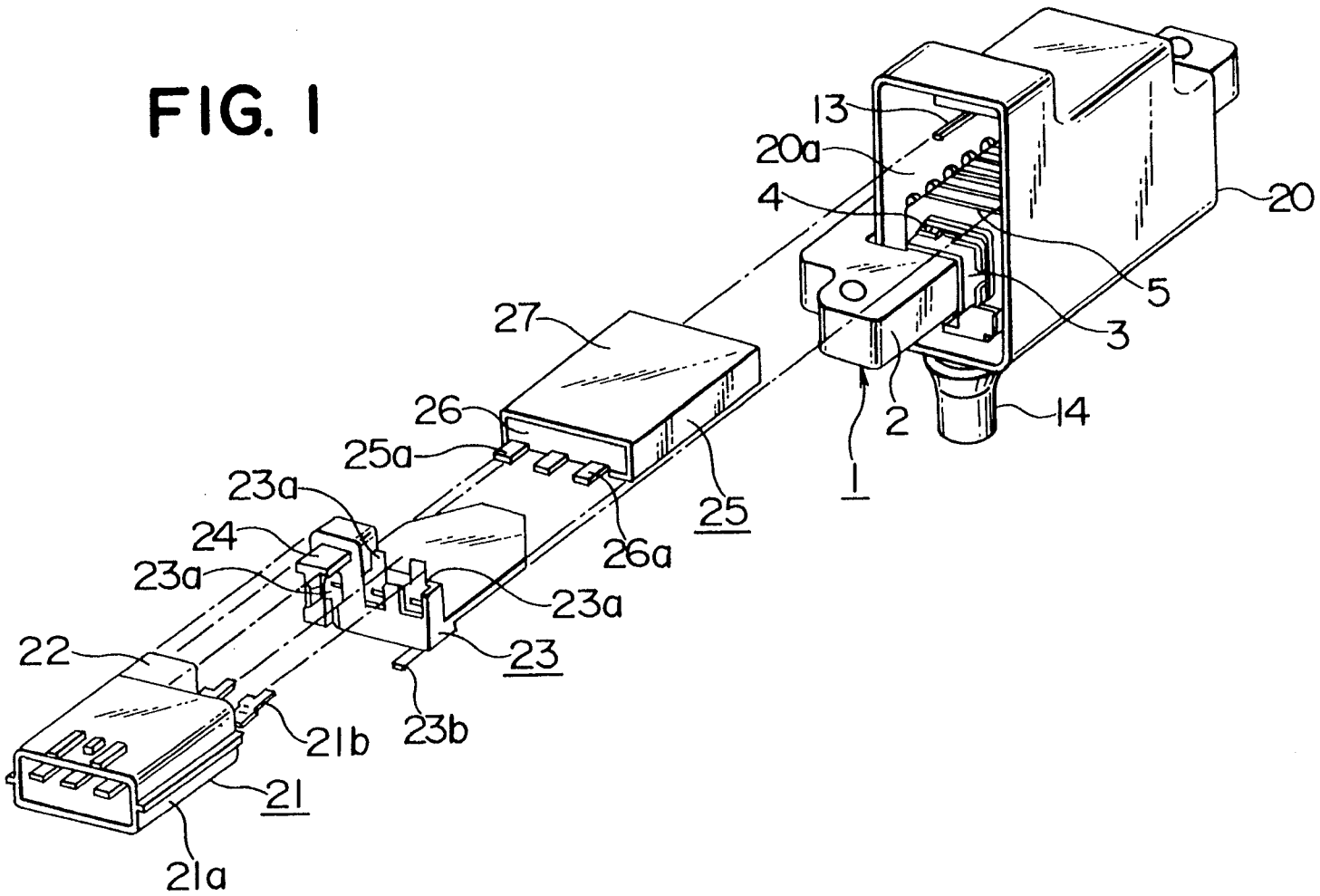
FIG. 1 is an exploded perspective view illustrating one embodiment of an ignitor of the present invention.
Figure 2:
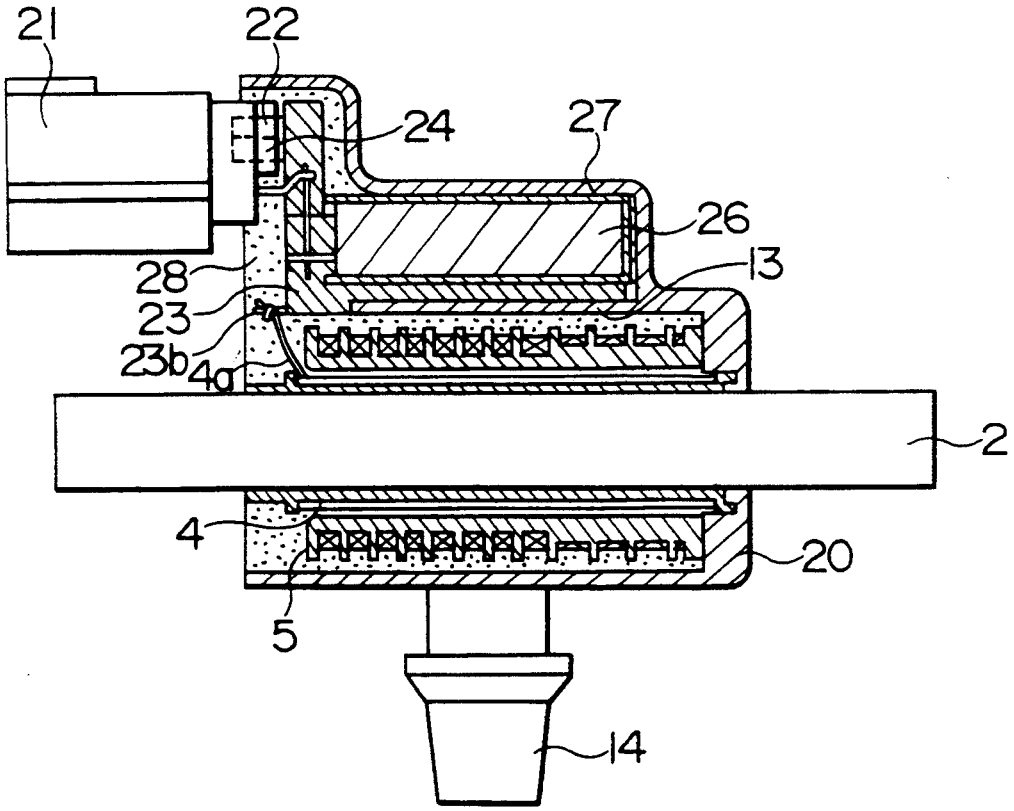
FIG. 2 is a sectional side view of the ignitor of the present invention.
Figure 3:
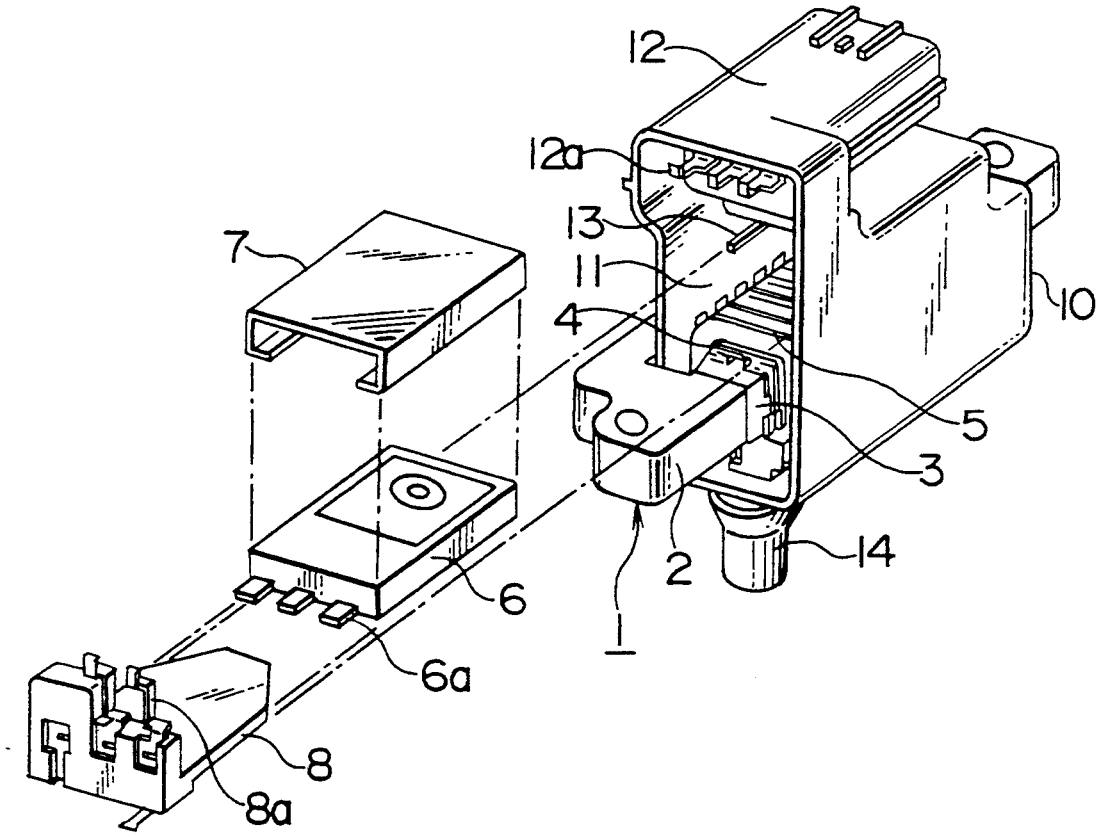
FIG. 3 is an exploded perspective view of a known ignitor.

FIGS. 1 and 2 illustrate one embodiment of the ignitor of the present invention, in which the ignitor for an internal combustion engine comprises a casing 20 and an ignition coil 1 mounted to an interior space or a mounting portion 20*a* of the casing 20. The ignition coil 1 is composed of an elongated ring-shaped iron core 2 made of a suitable magnetic material, a primary winding 4 wound around the iron core 2 and a secondary winding 5 concentrically wound around the primary winding 4. Disposed on the bottom of the casing 20 is a secondary terminal 14 electrically connected to the ignition coil 1 for supplying a high voltage generated in the secondary winding 5 of the ignition coil 1 to the ignition plug (not shown) through the distributor (not shown) to ignite the internal combustion engine (not shown).

The ignitor of the present invention comprises a power-transistor assembly 25 composed of a power transistor package 26 with a cover sheet 27, a holder 23 and an electrical connector 21. The power transistor assembly 25 is mounted and supported within the mounting portion 20*a* of the casing 20 along a pair of guides 13 attached to two internal side surfaces of the casing 20. The power-transistor package 26 comprises a resin-molded power transistor and a control circuit (not shown) for interrupting an electric current flowing through the primary winding 4 of the ignition coil 1. The power transistor package 26 has a plurality of terminals 26*a* extending from the package and is covered with cover means 27 made for example of a silicone sheet for the purpose which will become apparent later. The power-transistor assembly 25 also comprises a holder 23 made for example a mold resin and mounting the power transistor package 26 together with the cover means 27. The holder 23 comprises a plurality of conductive terminals 23*a* and 23*b* disposed thereon. The conductive terminals 23*a* are electrically connected at one end to the conductor pattern terminals 26*a* of the power-transistor package 26 and electrically connected at the other end to the conductive terminals 21*b* of the connector 21. The terminal 23*b* and one of the terminals 21*b* of the connector 21 are connected to the primary and secondary windings 4 and 5 of the ignition coil 1 through separate conductors 4*a* extending from the windings 4 and 5 as shown in FIG. 2. The conductive terminals 23*a* may be disposed insertedly within the holder 23 or disposed along the periphery of the holder 23. The electrical connector 21, which has an outer case 21*a* made for example of a mold resin, has a recessed coupler 22 for receiving a projection 24 provided on the holder 23. The projection 24 has a substantially T-shaped crosssection and snugly fit into the recessed coupler 22 so that a relatively firm mechanical connection is established between the holder 23 and the connector 21. The ignitor of the present invention also comprises an electrically insulating resin 28 made of a cured suitable electrically insulating resinous filler material filled within the interior space of the casing 20 for integrally and hermetically sealing therein the ignition coil 1, the power-transistor package 26 and the holder 23. Since the electrically insulating resin 28 has a different coefficient of thermal expansion from that of the mold resin of the power-transistor package 26, a stress is caused by the difference between those coefficients of thermal expansion resulting from repeated violent changes of temperature of the surroundings. However, the cover means 27 disposed therebetween can absorb the stress because the cover means 27 has a coefficient of thermal expansion between those of the electrically insulating resin and the mold resin package 26. Alternatively, the cover means 27 may be made of a suitable elastic resin so that the stress can be absorbed.

In the manufacture of the ignitor of the present invention as described above, firstly, the ignition coil 1 less the iron core 2 is disposed within the mounting portion 20*a* of the casing 20 in the similar manner to the known ignitor as described above. Secondly, the power transistor package 26 covered with the cover means 27 is mounted on the holder 23 and the conductor pattern terminals 26*a* of the power-transistor package 26 are electrically connected to the conductive terminals 23*a* of the holder 23. Next, the connector 21 is mounted to the holder 23 by means of couplers 22 and 24 snugly fitting each other and the conductive terminals 21*b* of the connector 21 and the terminals 23*a* of the holder 23 are electrically connected to each other, whereby the power transistor assembly 25 in which the power transistor package 26, the holder 23 and the connector 21 are assembled into a unitary structure and electrically connected together is obtained. This power transistor assembly 25 is inserted into the mounting portion 20*a* of the casing 20 along the pair of guides 13 provided on the internal surfaces of the casing 20 so that only the connector 21 remains outside of the casing 20.

Then, the remaining terminals such as the conductive terminal 23*b* of the holder 23 and one of the connector terminals 21*b* are electrically connected to the primary winding 4 and the second winding 5 of the ignition coil 1 through the conductive wires such as the conductor 4*a*. The electrical connections between the power transistor assembly 25 and the ignition coil 1 are established at positions below the connector 21 as best seen from the connection between the terminal 23*b* and the conductor 4*a* shown in FIG. 2. Therefore, the connections between the assembly 25 and the ignition coil 1 can be easily accessed and the wiring can be easily achieved.

Finally, after the iron core 2 is inserted into the primary winding 4, the insulating resinous filler material 28 is poured and filled within the interior space of the casing 20 and it is cured to seal integrally and hermetically therein the ignition coil 1 and the power-transistor assembly 25.

According to the ignitor of the present invention as described above, since the connector 21 is electrically connected to the power-transistor package 26 through the holder 23 before they are mounted into the casing 20, electrical connection between them can be carried out outside of the casing 20. The electrical connections that must be carried out within the casing 20 are the connections to the ignition coil 1. Therefore the ignitor of the present invention can be easily and reliably assembled and the manufacture processes are improved to be efficient.

As the cover means 27 can absorb a stress caused between the mold resin package 26 and the electrically insulating resin filled within the casing 20 due to the repeated violent changes of temperature of the surroundings resulting from the difference between their coefficients of thermal expansion, the ignitor of the present invention is durable in respect to a temperature change.

Further, since the conductive terminal 23*b* for being electrically connected to the ignition coil 1 is positioned in a position easily accessible from the outside of the casing 20 when the power-transistor package assembly 25 and the connector 21 are being mounted to the casing 20, they can be easily electrically connected to each other.

Still further, as the casing 20 and the connector 21 are separated from each other, the shape or the mounting direction of the connector 21 can be easily changed in correspondence with for example other components for the internal combustion engine to be electrically connected to the ignitor of the present invention. The ignitor of the present invention is versatile for use in various internal combustion engine.

When the connector 21 is mounted to the holder 23, the mounting position of the connector 21 can be easily determined correctly by using the fastening means comprising the receiving means such as a mortise 22 disposed to the connector 21 and the inserting means such as a tenon 24 disposed to the holder 23 which fit into each other, and therefore, simultaneously the positions of the connecting portions between the conductive terminals 21*b* and 23*a* thereof can be determined and they can be easily connected to each other correctly and tightly and the reliability becomes good.

What is claimed is:

1. An ignitor for an internal combustion engine, comprising:

a casing;

an ignition coil disposed within said casing;

a power-transistor package disposed within said casing and electrically connected to said ignition coil for interrupting an electric current flowing through said ignition coil;

an electrical connector mechanically attached to said power-transistor package and for electrically connecting said coil and said power transistor package to an external circuit; and an electrically insulating resin filled within said casing for hermetically sealing and supporting therein said ignition coil and said power-transistor package.

2. An ignitor as claimed in claim 1, wherein said power-transistor package comprises:

a power transistor for interrupting an electric current flowing through a primary winding of said ignition coil;

a mold resin package for hermetically sealing therein said power transistor; and a holder mounting said mold resin package and electrically connecting said electrical connector to said power-transistor package.

3. An ignitor as claimed in claim 2, wherein said electrical connector is fixed to said holder by fastening means.

4. An ignitor as claimed in claim 3, wherein said fastening means comprises:

inserting means disposed to said holder; and receiving means disposed to said electrical connector for receiving said inserting means;

said inserting means and said receiving means fitted into each other.

5. An ignitor as claimed in claim 3, wherein said fastening means comprises:

inserting means disposed to said electrical connector; and receiving means disposed to said holder for receiving said inserting means;

said inserting means and said receiving means fitted into each other.

6. An ignitor as claimed in claim 2, wherein said power-transistor package also comprises cover means for covering said mold resin package thereof.

7. An ignitor as claimed in claim 6, wherein said cover means made of a resinous material for absorbing a stress caused between said mold resin package and said electrically insulating resin by the difference between their coefficients of thermal expansion.

* * * * *